United States Patent [19]

Herendeen

[11] Patent Number: 5,016,852

[45] Date of Patent: May 21, 1991

[54] PORTABLE BOOKSTAND APPARATUS

[76] Inventor: Bella E. Herendeen, 4924 Nellie Springs Ct., Las Vegas, Nev. 89110

[21] Appl. No.: 541,390

[22] Filed: Jun. 21, 1990

[51] Int. Cl.[5] ..... A47B 19/00

[52] U.S. Cl. ..... 248/461; 248/447.2; 248/455; 248/462

[58] Field of Search ..... 248/461, 460, 441.1, 248/447, 445, 446, 447.1, 447.2, 453, 455, 462

[56] References Cited

U.S. PATENT DOCUMENTS

| | | | |
|---|---|---|---|
| 515,649 | 2/1894 | Brookmise | 248/461 |
| 535,557 | 3/1895 | Rockwell | 248/462 |
| 1,308,956 | 7/1919 | Krauth | 248/462 |
| 1,419,668 | 6/1922 | Fuller | 248/462 |
| 1,682,180 | 8/1928 | Merril | 248/462 |
| 3,249,383 | 5/1966 | Geller | 248/461 X |
| 3,514,173 | 5/1970 | Ford | 248/461 X |
| 4,191,354 | 3/1980 | Chin-Liu | 248/445 |
| 4,372,518 | 2/1983 | Biasini | 248/441.1 |
| 4,799,858 | 1/1989 | Shin-Chin | 248/231.5 X |

FOREIGN PATENT DOCUMENTS

| | | | |
|---|---|---|---|
| 751467 | 6/1933 | France | 248/462 |

*Primary Examiner*—Alvin C. Chin-Shue
*Attorney, Agent, or Firm*—Leon Gilden

[57] ABSTRACT

A book stand including a spring clip formed at its base, with a spine mounted to the clip. The spine pivotally mounts da plurality of "U" shaped support channels longitudinally aligned and in a contiguous relationship relative to one another in a first position and arranged parallel in an inter-folded second position, with a foldable linkage arrangement mounted overlying the support channels to permit inter-folding of the organization along the spine, with a self-contained illumination member mounted at an upper end of the spine. The organization is inter-folded to be received within a storage and transport pouch during periods of non-use.

1 Claim, 4 Drawing Sheets

17
18
16
19
37
35
39
29
20
41
40
42
43
27
38
34
31
36
44
30
32
33
21
15
28
14
45
25
22
23
24
26
46
47
13
13a
11
12a
12

PORTABLE BOOKSTAND APPARATUS

BACKGROUND OF THE INVENTION

1. Field of the Invention

The field of invention relates to portable bookstand apparatus, and more particularly pertains to a new and improved portable book stand apparatus wherein the same is readily mounted to and accommodates a variety of support surfaces and is readily inter-folded for ease of transport and storage.

2. Description of the Prior Art

Recreational and job related reading is a frequent and reoccurring event in contemporary lifestyles. Reading may be effected in a variety of positions including a bed, chair, a table, and the like. The instant invention attempts to provide an organization to accommodate mounting of reading material relative to a desired location, and to this effect, the organization attempts to overcome deficiencies of the prior art by generally accommodating reading in a limited forum environment.

Examples of the prior art include U.S. Pat. No. 4,771,977 to Larson setting forth a book support utilizing a support plate and vertically oriented mount utilizing rearwardly and vertically mounted wings to support the organization relative to an underlying generally planar surface.

U.S. Pat. No. 3,514,066 to Singleton, et al. sets forth the use of a "U" shaped clamp mounted to a bed frame member, utilizing a telescoping pole member to mount a book rest and support clamping arrangement thereon.

U.S. Pat. No. 3,884,538 to Wise sets forth an illuminated book holder utilizing a support platform and illumination member overlying the platform to direct illumination onto an associated book mounted on the platform.

U.S. Pat. No. 4,465,255 to Hill sets forth a book support arrangement for mounting to a bed, wherein a transparent support plate mounts a book in a face-down orientation overlying a reader thereon.

U.S. Pat. No. 4,801,120 to Gregoire provides a book support with a support post mounting an angulated book support mount thereon.

As such, it may be appreciated that there continues to be a need for a new and improved portable bookstand apparatus wherein the same addresses both the problems of ease of use, as well as effectiveness in construction in accommodating books and the like in a variety of orientations and positions and in this respect, the present invention substantially fulfills this need.

SUMMARY OF THE INVENTION

In view of the foregoing disadvantages inherent in the known types of portable bookstand apparatus now present in the prior art, the present invention provides a portable bookstand apparatus wherein the same accommodates a variety of book support mounting arrangements and is readily inter-folded for transport and storage. As such, the general purpose of the present invention, which will be described subsequently in greater detail, is to provide a new and improved portable bookstand apparatus which has all the advantages of the prior art portable bookstand apparatus and none of the disadvantages.

To attain this, the present invention provides a bookstand including a spring clip formed at its base, with a spine mounted to the clip. The spine pivotally mounts a plurality of "U" shaped support channels longitudinally aligned and in a contiguous relationship relative to one another in a first position and arranged parallel to an inter-folded second position, with a foldable linkage arrangement mounted overlying the support channels to permit inter-folding of the organization along the spine, with a self-contained illumination member mounted at an upper end of the spine. The organization is interfolded to be received within a storage and transport pouch during periods of non-use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable bookstand apparatus which has all the advantages of the prior art portable bookstand apparatus and none of the disadvantages.

It is another object of the present invention to provide a new and improved portable bookstand apparatus which may be easily and efficiently manufactured and marketed.

It is a further object of the present invention to provide a new and improved portable bookstand apparatus which is of a durable and reliable construction.

An even further object of the present invention is to provide a new and improved portable bookstand apparatus which is susceptible of a low cost of manufacture with regard to both materials and labor, and which accordingly is then susceptible of low prices of sale to the consuming public, thereby making such portable bookstand apparatus economically available to the buying public.

Still yet another object of the present invention is to provide a new and improved portable bookstand apparatus which provides in the apparatuses and methods of the prior art some of the advantages thereof, while simultaneously overcoming some of the disadvantages normally associated therewith.

Still another object of the present invention is to provide a new and improved portable bookstand apparatus wherein the same is mounted to a variety of underlying supports mounting the apparatus thereon, with the apparatus arranged for interfolding and reception within an associated transport container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
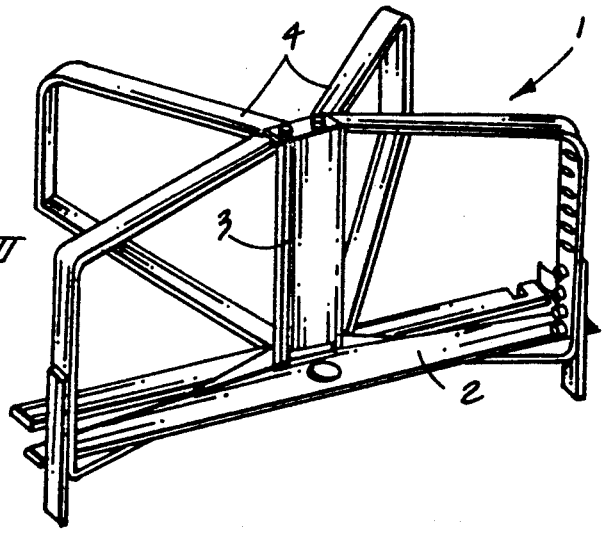
Fig 1 PRIOR ART
FIG. 1 is an isometric illustration of a prior art bookstand apparatus.

With reference now to the drawings, and in particular to FIGS. 1 to 7 thereof, a new and improved portable bookstand apparatus embodying the principles and concepts of the present invention and generally designated by the reference numeral 10 will be described.

Figure 2:
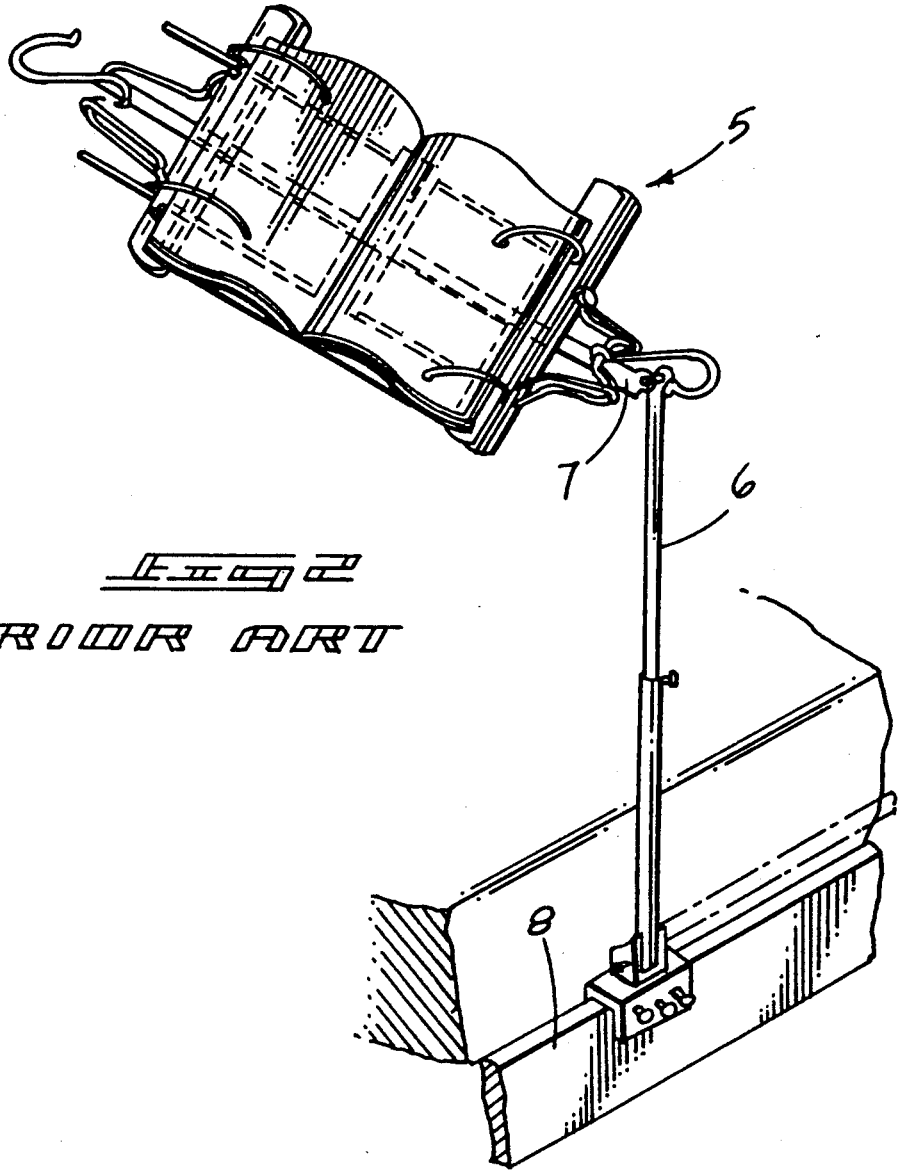
Fig 2 PRIOR ART
FIG. 2 is an isometric illustration of a further prior art bookstand apparatus.

FIG. 1 illustrates a prior art bookstand apparatus 1, including a support plate 2, with a rear vertical support plate 3 to support a book positioned thereon, with wing members 4 pivotally mounted to the vertical support to effect stability of the organization. FIG. 2 illustrates a further prior art bookstand apparatus 5, wherein a telescoping support rod 6 includes a support bracket 7 mounting clamps thereon. The organization is mounted to a bed frame 8 for securement and storage thereon.

Figure 4:
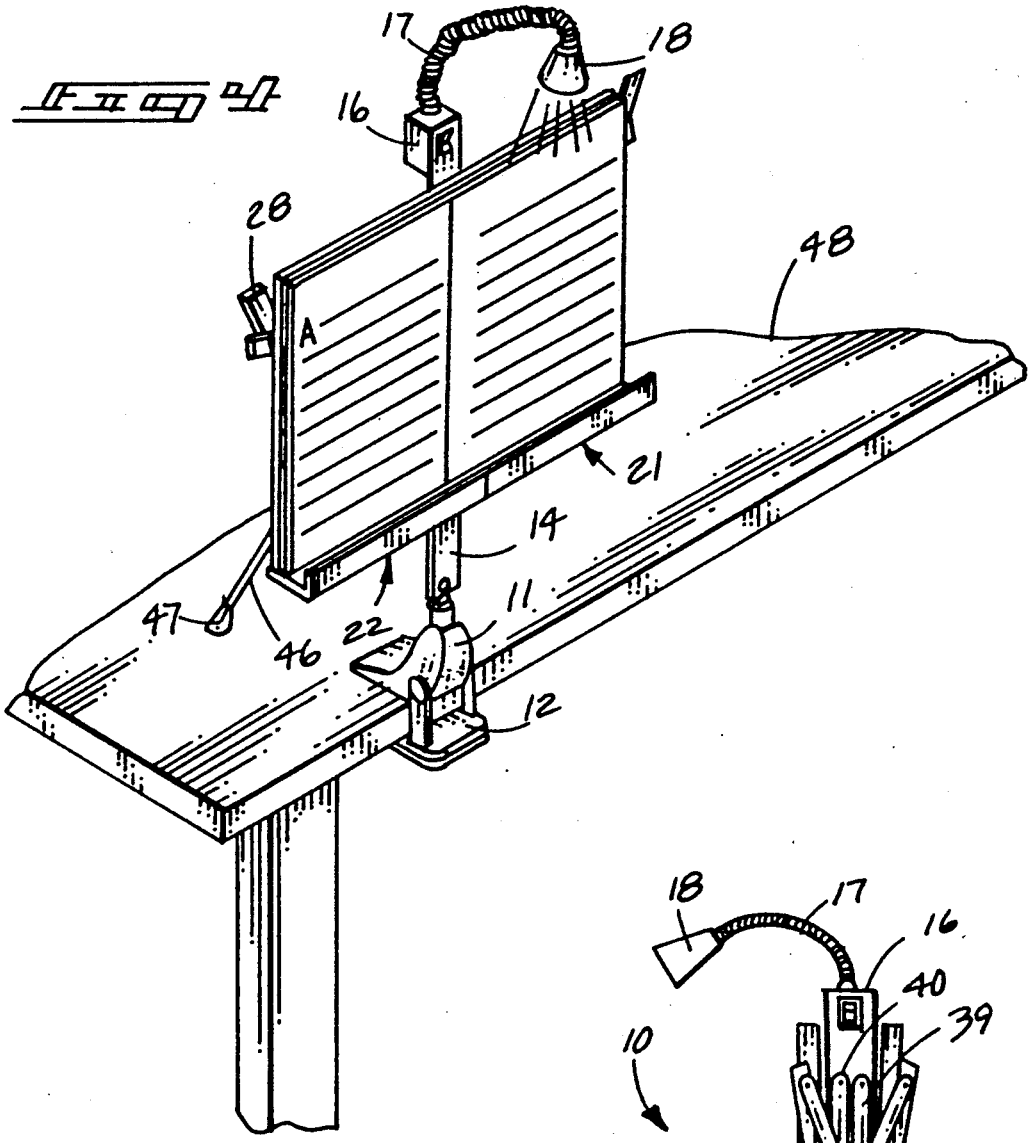
FIG. 4 is an isometric illustration of the instant invention mounted to a support table.

More specifically, the portable bookstand apparatus 10 of the instant invention essentially comprises a support foot 11, including a planar clamping surface cooperative with a spring clip 12 mounted cooperating with the clamping surface, wherein the spring clip plate 12 includes a resilient pad **12*a* mounted between the support foot 11 and the spring clip 12 to enhance frictional engagement to a support, such as illustrated in FIG. 4. A pivot connection 13 mounts a central spine plate 14 to the support foot, wherein the pivot connection may include a pivot lock 13*a* that is threadedly directed into the pivot connection 13 to fixedly secure the pivot connection in a predetermined angular orientation between the spine plate 14 and the support foot 11. The spine plate 14 includes a longitudinal slot 15 directed through the spine plate to slidingly accommodate support linkage, to be described in more detail below. A housing 16 is integrally mounted to a top terminal end portion of the spine plate 14 and includes a flexible neck 17 mounted to the housing 16, with an illumination member 18 mounted at a free terminal end of the flexible neck 17. A switch 19 mounted to the housing 16 directs electrical energy through a replaceable battery 20 contained within the housing 16 to effect illumination of the illumination member 18**.

Figure 3:
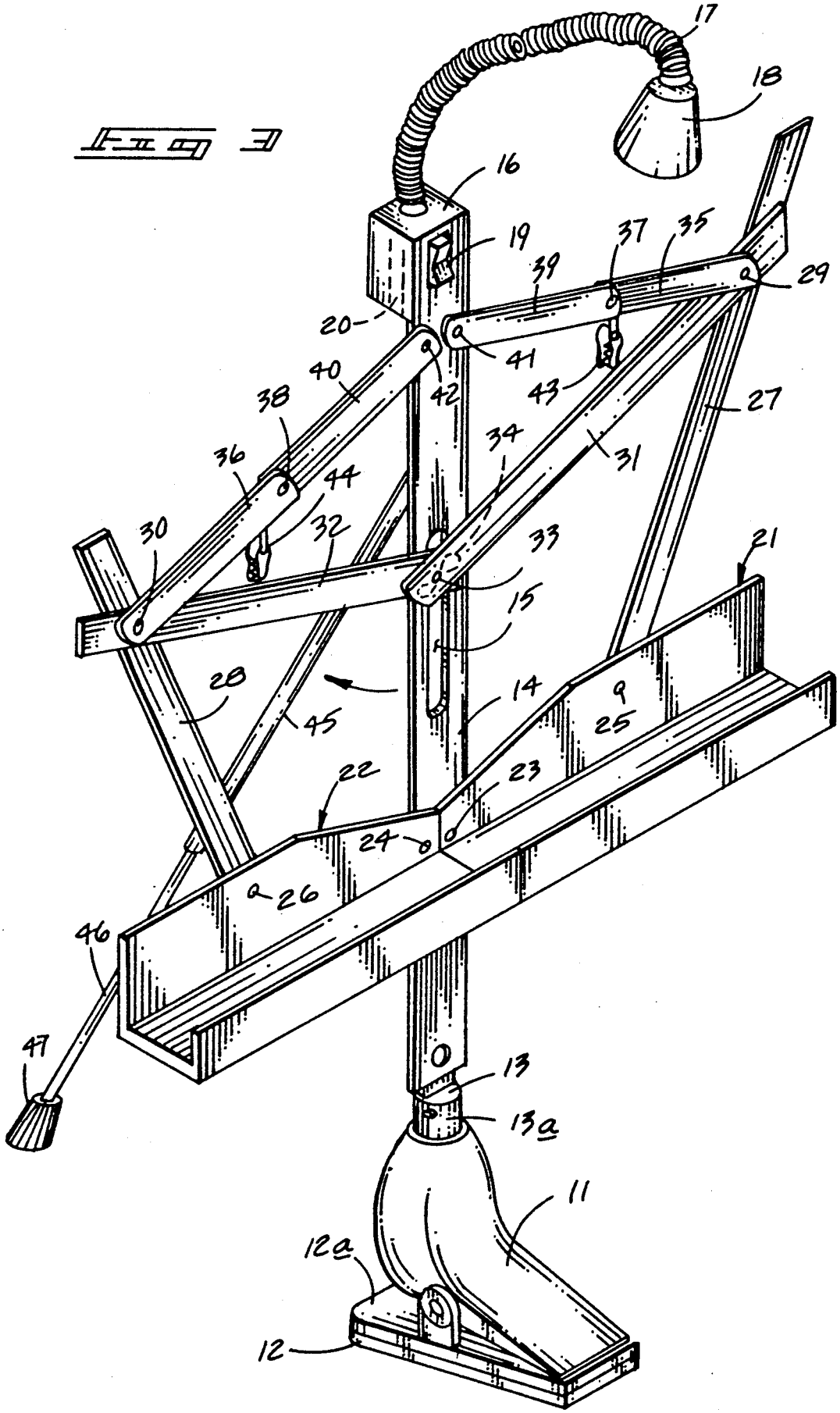
FIG. 3 is an isometric illustration of the instant invention.
Figure 5:
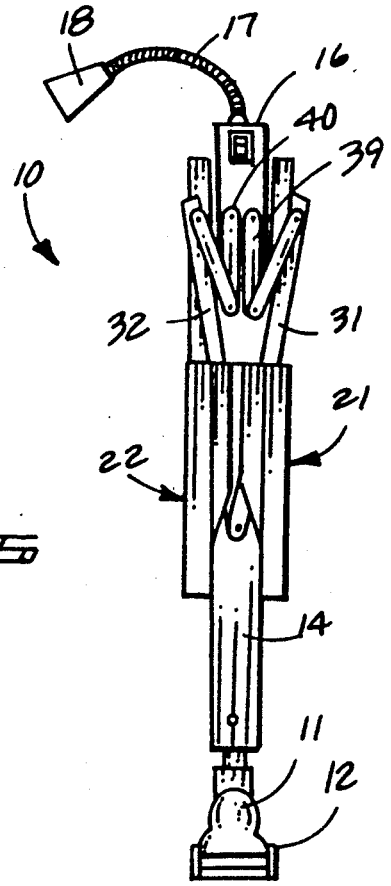
FIG. 5 is an orthographic frontal view, taken in elevation, of the apparatus in a folded configuration.

A first "U" shaped tray 21 and a second "U" shaped tray 22 are pivotally mounted to the spine plate 14 underlying the slot 15, including a respective first and second tray pivot axle 23 and 24 that are mounted to respective adjacent forward ends of each tray, with the forward ends of each tray in contiguous and aligned contact relative to one another when the first and second trays are in the first extended orientation, as illustrated in FIG. 3, and are in a generally parallel relationship when pivoted about their respective first and second pivot axles 23 and 24 in a second inter-folded relationship, as illustrate in FIG. 5 for example. A third and fourth tray pivot axle 25 and 26 are mounted medially of a rear wall of each first and second tray 21 and 22 respectively to pivotally mount a respective first and second link 27 and 28 to the rear wall of each tray. The first and second links 27 and 28 include respective first and second linkage pivot axles 29 and 30 adjacent upper terminal ends of each first and second link remote from the respective first and second trays 21 and 22. A third link 31 and a fourth link 32 are pivotally mounted to the respective first and second linkage pivot axle 29 and 30 adjacent outer ends of the third and fourth links 31 and 32, with a central third linkage pivot axle 33 directed adjacent interior terminal ends of the third and fourth links 31 and 32, and through the slot 15 to permit a sliding mounting of the third link pivotal axle 33 within the slot 15, wherein the pivot axle 33 in a raised orientation within the slot 15 arranges the trays 21 and 22 in the first position, while a lowered orientation of the third linkage pivot axle 33 within the slot 15 as illustrated in FIG. 5 for example directs the trays 21 and 22 into a second parallel relationship relative to one another. The pivot axle 33 includes a clamp 34 that may be optionally used, such as a wing nut and the like, mounted to the pivot axle 33 that is threaded and directed rearwardly through the clamp 34 to ensure a locking engagement of the pivot axle 33 relative to the slot 15. A fifth link 35 and a sixth link 36 are respectively mounted to the respective first and second linkage pivot axles 29 and 30, while a fourth linkage pivot axle 37 and a fifth linkage pivotal axle 38 are mounted to interior terminal ends of the fifth and sixth links 35 and 36 spaced from the first and second linkage pivot axles 29 and 30 respectively. A seventh link and an eighth link 39 and 40 are respectively mounted to the fifth and sixth links 35 and 36 through the respective fourth and fifth linkage pivot axles 37 and 38. Interior terminal ends of the seventh and eighth links 39 and 40 are pivotally mounted to the spine 14 utilizing a sixth and seventh linkage pivot axle 41 and 42. This organization permits inter-folding of the relationship of the second configuration, as illustrated in FIG. 4. A first spring biased securement clip 43 is mounted to the fourth linkage pivot axle 37, while a second spring biased securement clip 44 is mounted to the fifth linkage pivot axle 38 to enhance securement of a book and the like mounted within the first and second trays 21 and 22. A first pivot leg 45 is pivotally mounted above the slot 15 to a rear surface of the spine 14 and includes a telescoping second pivot leg 46 retractably mounted within the first pivot leg 45, with a friction foot covering 47 mounted to a free terminal end of the second pivot leg 46 for a stabilizing organization, in a manner as illustrated in FIG. 4 for example.

Figure 6:
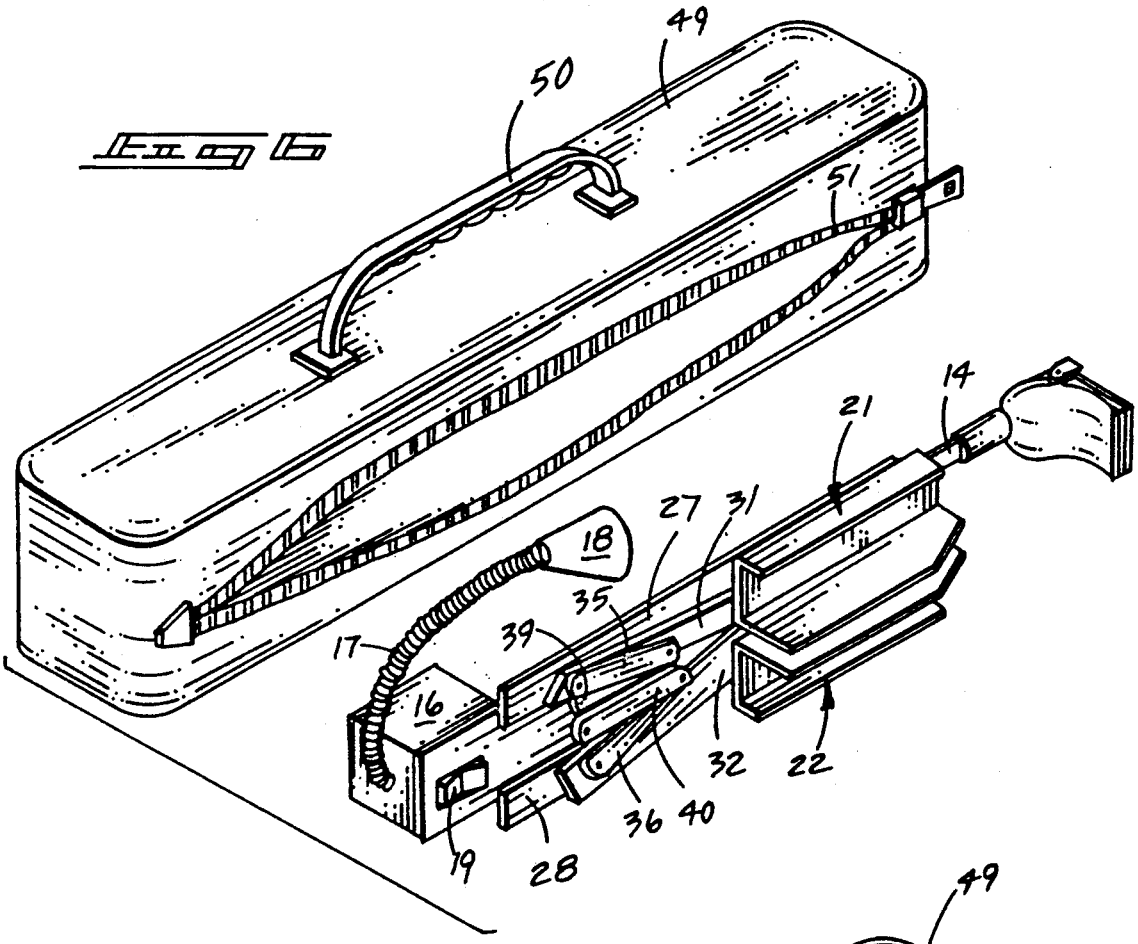
FIG. 6 is an isometric illustration of the apparatus in association with a transport container.
Figure 7:
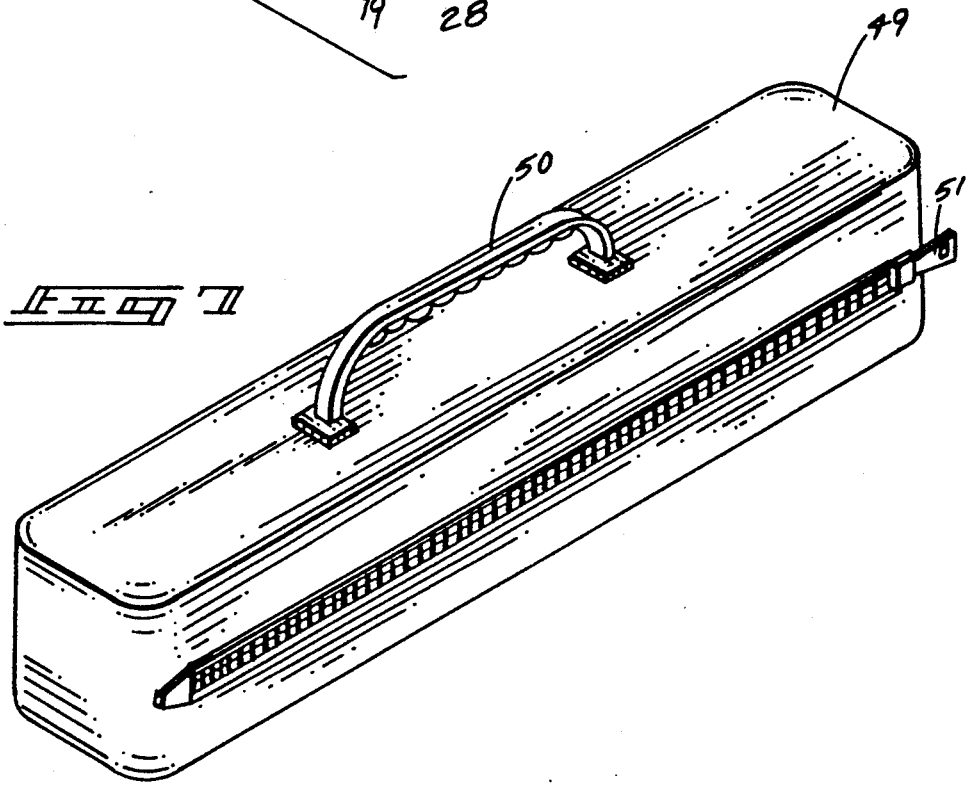
FIG. 7 is an isometric illustration of the transport container when the apparatus is positioned therewithin.

FIGS. 6 and 7 illustrate the use of a flexible transport housing 49 including a handle 50 mounted to a top wall of the housing 49, and an elongate zipper 51 providing access to an interior cavity of the housing 49 to receive the inter-folded bookstand when inter-folded into the second orientation, as illustrated in FIG. 6.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable bookstand apparatus comprising, in combination, a central spine plate, including a lower terminal end and an upper terminal end, the lower terminal end including a spring clip member mounted thereto, and the upper terminal end of the central spine plate including a housing mounted thereon, the housing including a flexible neck mounted thereto, the flexible neck mounting an illumination member to the flexible neck spaced from the housing, the housing including a switch member to effect selective illumination of the illumination member, and a first "U" shaped tray pivotally mounted to the spine plate in alignment with a second "U" shaped tray mounted to the spine plate, when the first and second "U" shaped trays are in a first lowered position, and wherein the first and second "U" shaped trays are arranged parallel relative to one another when the first and second "U" shaped trays are in a second folded position, and wherein the spring clip member includes a support foot mounted to the spine plate, and a spring clip plate biased against the support foot, including a resilient pad mounted to the spring clip plate between the support foot and the spring clip plate, and a pivot connection mounting the lower terminal end of the spine plate to support the foot, and including a pivot lock directed through the pivot connection to selectively lock the spine plate to the pivot connection in a predetermined angular orientation, and wherein the spine plate includes a longitudinally aligned and enclosed slot directed through the spine plate spaced above the first and second "U" shaped tray, and each first and second "U" shaped tray including a respective first and second rear wall, a first link pivotally mounted medially of the first rear wall, and the second link pivotally mounted rearwardly of the second rear wall, and the first and second links including a respective first and second linkage pivot axle adjacent an upper terminal end of each respective first and second link, and a third and fourth link each including a respective third and fourth link rear terminal end mounted to the respective first and second link at a respective first and second linkage pivot axle, and the third and fourth link including a third linkage pivotal axle mounted through and adjacent a forward terminal end of each respective first and second linkage pivot axle to secure the first and second linkage pivotal axles together in an overlying relationship and to simultaneously secure the forward terminal ends of each third and fourth link overlying and slidable relative to the slot, and the third linkage pivot axle directed through the slot, and a third linkage pivot axle clamp selectively clamping the third linkage pivot axle within the slot, wherein the third linkage pivot axle arranged in an upper orientation within the slot in the first position and positioned adjacent a lower terminal end of the slot in a second position, and including a fifth link mounted to the first linkage pivot axle and a sixth link mounted to the second linkage pivot axle, and a seventh link mounted to the fifth link, and an eighth link pivotally mounted to the sixth link, wherein the seventh and eighth links are also mounted to the spine plate adjacent the housing, and including a first pivot leg mounted to a rear surface of the spine plate above the slot, wherein the first pivot leg includes a second pivot leg telescopingly received within the first pivot leg, and the second pivot leg includes a frictional foot covering overlying a free terminal end of the second pivot leg, and wherein the apparatus further includes a flexible transport housing, the flexible transport housing including a handle mounted to the top wall of the housing, and including an elongate zipper mounted through a forward wall of the housing to define a cavity within the housing to receive the apparatus when the apparatus is in the second position.

* * * * *